US009721745B2

(12) United States Patent
Steinberger et al.

(10) Patent No.: US 9,721,745 B2
(45) Date of Patent: Aug. 1, 2017

(54) FUSE LOAD-BREAK SWITCH FOR LOW-VOLTAGE HIGH-POWER FUSES

(71) Applicant: Woehner GmbH & Co. KG Elektrotechnische Systeme, Roedental (DE)

(72) Inventors: Philipp Steinberger, Coburg (DE); Joram Masel, Kronach (DE); Christopher Curth, Neustadt (DE); Hans-Juergen Henning, Ebersdorf (DE); Daniel Steiner, Mengersgereuth-Haemmern (DE)

(73) Assignee: Woehner GmbH & Co. KG Elektrotechnische Systeme, Roedental (DE)

( * ) Notice: Subject to any disclaimer, the term of this patent is extended or adjusted under 35 U.S.C. 154(b) by 110 days.

(21) Appl. No.: 14/631,034

(22) Filed: Feb. 25, 2015

(65) Prior Publication Data

US 2015/0243467 A1 Aug. 27, 2015

(30) Foreign Application Priority Data

Feb. 26, 2014 (EP) ..... 14156859

(51) Int. Cl.
*H01H 85/43* (2006.01)
*H01H 9/10* (2006.01)
(Continued)

(52) U.S. Cl.
CPC ..... *H01H 85/43* (2013.01); *H01H 9/102* (2013.01); *H01H 31/122* (2013.01);
(Continued)

(58) Field of Classification Search
CPC ..... H01H 85/43; H01H 9/102; H01H 85/47; H01H 31/122; H01H 2213/00; H01H 9/342; H01H 9/34
(Continued)

(56) References Cited

U.S. PATENT DOCUMENTS 2,030,506 A * 2/1936 Driescher ..... H01H 31/122 337/211
6,333,845 B1 * 12/2001 Hashizawa ..... H01H 9/10 337/194
(Continued)

FOREIGN PATENT DOCUMENTS

AU 1220097 7/1997
DE 29622551 U1 2/1997
(Continued)

OTHER PUBLICATIONS

EP/0926692, Jun. 30, 1999, English Machine Translation.*
Wohner GmbH & Co. KG Elektrotechnische Systeme, Extended European Search Report, Jul. 18, 2014.

*Primary Examiner* — Anatoly Vortman
(74) *Attorney, Agent, or Firm* — Michael G. Johnston; Moore & Van Allen PLLC

(57) ABSTRACT

Fuse load-break switch (1) for low-voltage high-power fuses, a fuse contact pair for receiving a fuse (5A, 5B, 5C) being provided within a housing (2) of the fuse load-break switch (1) for each current phase to be disconnected, characterized in that a thermal power loss brought about by the fuses (5A, 5B, 5C) is dissipated into at least one heat dissipation duct (3) provided laterally on the housing (2) of the fuse load-break switch (1).

22 Claims, 10 Drawing Sheets

(51) Int. Cl.
*H01H 31/12* (2006.01)
*H01H 85/47* (2006.01)
*H01H 9/34* (2006.01)

(52) U.S. Cl.
CPC ..... *H01H 85/47* (2013.01); *H01H 9/34* (2013.01); *H01H 9/342* (2013.01); *H01H 2213/00* (2013.01)

(58) Field of Classification Search
USPC ..... 337/203
See application file for complete search history.

(56) References Cited

U.S. PATENT DOCUMENTS 6,531,948 B1 * 3/2003 Mennell ..... H01H 85/0208 337/168
6,650,222 B2 * 11/2003 Darr ..... H01H 9/104 337/187
7,561,018 B2 * 7/2009 Buettner ..... H01H 85/205 337/186
7,932,804 B2 * 4/2011 Buettner ..... H01H 85/205 337/181
8,098,126 B2 * 1/2012 Niedzwiecki ..... H01H 9/102 337/187
8,319,132 B2 * 11/2012 Buettner ..... H01H 9/226 200/400
8,830,024 B2 * 9/2014 Buettner ..... H01H 31/122 337/181
9,136,083 B2 * 9/2015 Brakefield ..... H01R 13/648
2009/0243786 A1 * 10/2009 Buettner ..... H01H 85/30 337/203

FOREIGN PATENT DOCUMENTS

EP 0926692 A2 6/1999
EP 1045414 A1 10/2000
EP 1302957 A1 4/2003
EP 2367192 A1 9/2011

* cited by examiner

FUSE LOAD-BREAK SWITCH FOR LOW-VOLTAGE HIGH-POWER FUSES

FIELD OF THE INVENTION

Fuse load-break switches are used as current distribution components for the electrical power supply within buildings, for example office centres or businesses, and in electric utility companies. Fuse load-break switches are used as current distribution components for currents having high current amplitudes.

TECHNICAL BACKGROUND

The fuse load-break switches can be mounted on busbars for different current phases of a multi-phase power supply system. The busbars generally extend horizontally and the fuse load-break switches are mounted transversely or vertically on the busbars. Within the housing of the fuse load-break switch, a fuse contact pair for receiving a fuse insert is provided for each current phase to be disconnected. After being mounted on the busbars, the fuses or fuse inserts are thus arranged in a row substantially mutually perpendicular.

In conventional fuse load-break switches, a drawback is that a thermal power loss brought about by the fuse inserts or fuses flows upwards within the housing of the fuse load-break switch, in such a way that a heat build-up can form in the upper region within the housing and can heat up the fuse inserts located in this region to an unacceptable degree. Further, the heat build-up in the upper region of the housing of the fuse load-break switch can lead to the fuse inserts located there ageing as a result of the increased temperatures, meaning that the possibility of uncontrolled triggering of the relevant fuse inserts cannot be excluded.

It is therefore an object of the present invention to provide a fuse load-break switch for low-voltage high-power fuses in which a heat build-up within the housing is reliably prevented.

SUMMARY OF THE INVENTION

The invention accordingly provides a fuse load-break switch for low-voltage high-power fuses, a fuse contact pair for receiving a fuse insert being provided within a housing of the fuse load-break switch for each current phase to be disconnected, the fuse load-break switch being distinguished in that a thermal power loss brought about by the fuse inserts is dissipated into at least one heat dissipation duct provided laterally on the housing of the fuse load-break switch.

In one possible embodiment of the fuse load-break switch according to the invention, switching gases are dissipated into a switching gas dissipation duct, which is provided laterally on the housing of the fuse load-break switch and separated from the heat dissipation duct.

In a further possible embodiment of the fuse load-break switch according to the invention, each fuse contact pair comprises two fuse contacts, which are each covered by a shock protection cap.

The shock protection cap is preferably formed symmetrically and has two cap heads.

In one possible embodiment, the two cap heads of the shock protection cap each comprise outlet openings for releasing heat into the heat dissipation duct and for dissipating switching gases into the switching gas dissipation duct.

In one possible embodiment of the fuse load-break switch according to the invention, the fuse load-break switch is mounted transversely on substantially horizontally extending busbars, a plurality of fuse inserts provided for the different busbars being arranged in a row together within the housing of the mounted fuse load-break switch.

In a further possible embodiment of the fuse load-break switch according to the invention, a vertically extending heat dissipation duct, through which the thermal power loss brought about by the fuse inserts escapes, is provided on one of the two side walls of the housing of the fuse load-break switch mounted on the busbars.

In a further possible embodiment of the fuse load-break switch according to the invention, a vertically extending switching gas dissipation duct, for dissipating a switching gas produced during switching, is provided on one or both side walls of the housing of the fuse load-break switch mounted on the busbars.

In a further possible embodiment of the fuse load-break switch according to the invention, a fuse contact of a fuse contact pair is connected to a connecting bracket via a fuse contact bracket and two parallel planar output rail parts.

In one possible embodiment of the fuse load-break switch according to the invention, the fuse contact bracket is fixed between the two output rail parts at a first end of the two parallel output rail parts In a further possible embodiment of the fuse load-break switch according to the invention, the connecting bracket is fixed between the two output rail parts at a second end of the two parallel output rail parts.

In a further possible embodiment of the fuse load-break switch according to the invention, the parallel output rail parts are inserted into an inner guide duct extending parallel to the side walls of the housing within the housing of the fuse load-break switch.

In a further possible embodiment of the fuse load-break switch according to the invention, at least a further parallel outer guide duct for receiving electrical lines is provided between the side walls of the housing and the inner guide duct.

In a further possible embodiment of the fuse load-break switch according to the invention, the guide ducts extend substantially vertically within the housing of the fuse load-break switch mounted on the busbars, the thermal losses of the output rails and/or the electrical lines being dissipated upwards through openings of the housing to the outside.

In a further possible embodiment of the fuse load-break switch according to the invention, the heat dissipation duct and the switching gas dissipation duct each extend along as a tub-shaped depression on the side walls of the housing of the fuse load-break switch and form, together with a heat dissipation duct and a switching gas duct of another fuse load-break switch arranged directly alongside, two closed ducts or separately dissipating thermal power losses and the switching gases.

In a further possible embodiment of the fuse load-break switch according to the invention, to disconnect a current phase the corresponding fuse insert can be pivoted out of the associated fuse contact pair.

In one possible embodiment of the fuse load-break switch according to the invention, a plurality of current phases can be disconnected simultaneously using a centrally arranged, manually actuable switching handle.

In one possible embodiment of the fuse load-break switch according to the invention, the manually actuable switching handle is attached to a push rod, which is located in the housing of the fuse load-break switch and which pivots the fuse inserts out of the fuse contact pairs associated with the current phases.

The invention further provides a current distribution arrangement comprising a plurality of substantially horizontally extending busbars for different current phases of a multi-phase power supply system and at least one fuse load-break switch as described herein for use with low-voltage high-power fuses and being mounted on the busbars.

The invention accordingly provides a current distribution arrangement comprising a plurality of substantially horizontally extending busbars for different current phases of a multi-phase power supply system, at least one fuse load-break switch for low-voltage high-power fuses being mounted on the busbars, the fuse load-break switch having a housing, and a fuse insert being provided within the housing of the fuse load-break switch for each current phase to be disconnected, a thermal power loss brought about by the fuse inserts being dissipated into at least one heat dissipation duct provided laterally on the housing of the fuse load-break switch.

In one possible embodiment of the current distribution according to the invention, the current distribution arrangement is configured for nominal currents of more than 600 amps.

In one possible embodiment of the current distribution according to the invention, the busbars are arranged with a rail spacing of 185 mm.

In one possible embodiment of the current distribution according to the invention, the busbars each have a busbar width of up to 120 mm.

In one possible embodiment of the current distribution according to the invention, the fuses or fuse inserts are low-voltage high-power fuses.

In an alternative embodiment of the current distribution according to the invention, the fuses or fuse inserts are UL fuses.

In one possible embodiment of the current distribution according to the invention, the fuse load-break switch can be connected in a single-pole manner.

In an alternative embodiment of the current distribution according to the invention, the fuse load-break switch can be connected in a multi-pole manner.

BRIEF DESCRIPTION OF FIGURES

In the following, possible embodiments of the fuse load-break switch according to the invention and the current distribution arrangement according to the invention are described in greater detail with reference to the accompanying drawings, in which.

DETAILED DESCRIPTION OF EMBODIMENTS

Figure 1:
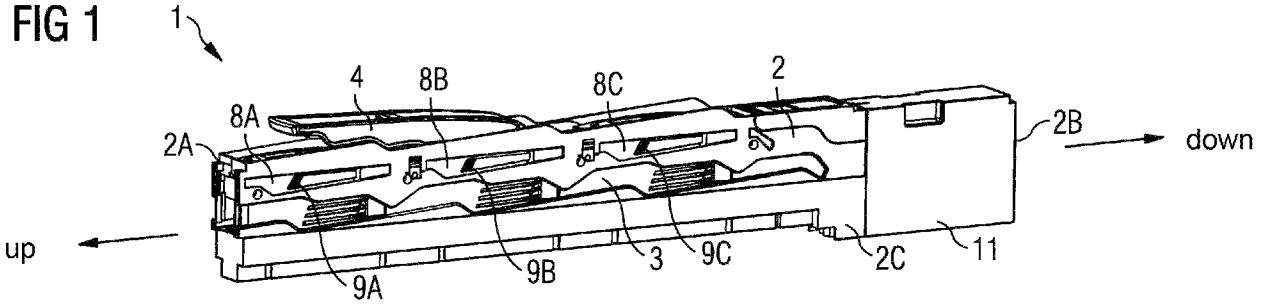
FIG. 1 shows one possible embodiment of the fuse load-break switch according to the invention in a closed switch position.

FIG. 1 shows an embodiment of a fuse load-break switch 1 according to the invention for low-voltage high-power fuses. In the embodiment shown in FIG. 1, the fuse load-break switch 1 is triple-pole and serves to receive three low-voltage high-power fuses for three different current phases. In the embodiment shown in FIG. 1, the fuse load-break switch can be connected in a multi-pole manner, in other words all current phases can be disconnected simultaneously by actuating a switching handle. In an alternative embodiment of the fuse load-break switch 1 according to the invention, the fuse load-break switch 1 can be connected in a single-pole manner, in other words each current phase L1, L2, L3 to be disconnected can be disconnected separately using an associated switching handle 4. The fuse load-break switch 1 comprises a housing 2. The housing 2 is preferably composed of a plurality of housing components. Within the housing 2 of the use load-break switch 1, for each current phase to be disconnected, a fuse contact pair for receiving an associated fuse insert 5A, 5B, 5C is provided. A thermal power loss brought about by the fuse inserts 5A, 5B, 5C is dissipated into a heat dissipation duct 3, shown in FIG. 1, provided laterally on the housing 2 of the fuse load-break switch 1. A manually actuable switching handle 4 is provided centrally on the housing 2 of the fuse load-break switch 1. The switching handle 4 is preferably attached to a movable push rod, which is located in the housing 2 of the fuse load-break switch 1 and which pivots the fuse inserts 5A, 5B, 5C out of the fuse contact pairs associated with the current phases L1, L2, L3.

Figure 2:
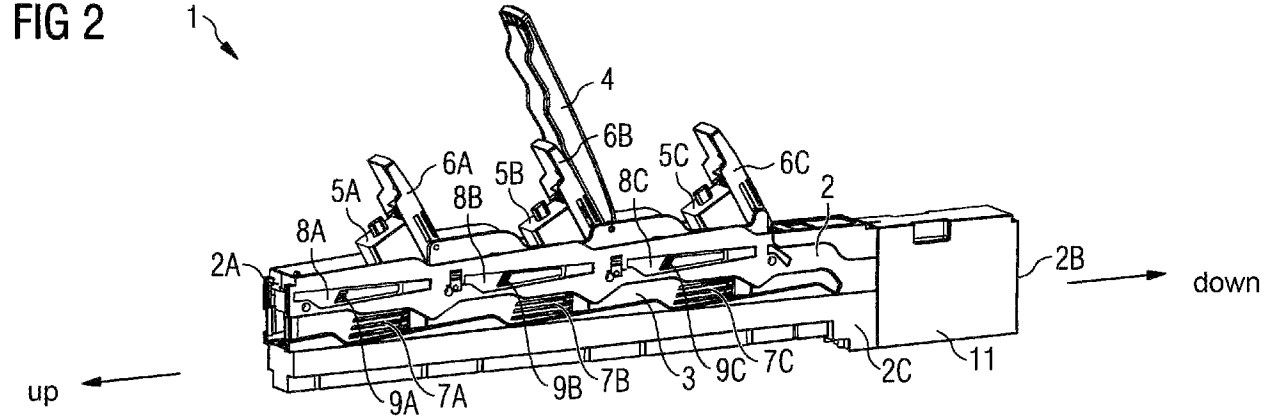
FIG. 2 shows the manually actuable fuse load-break switch of FIG. 1 in an open switch position.
Figure 5:
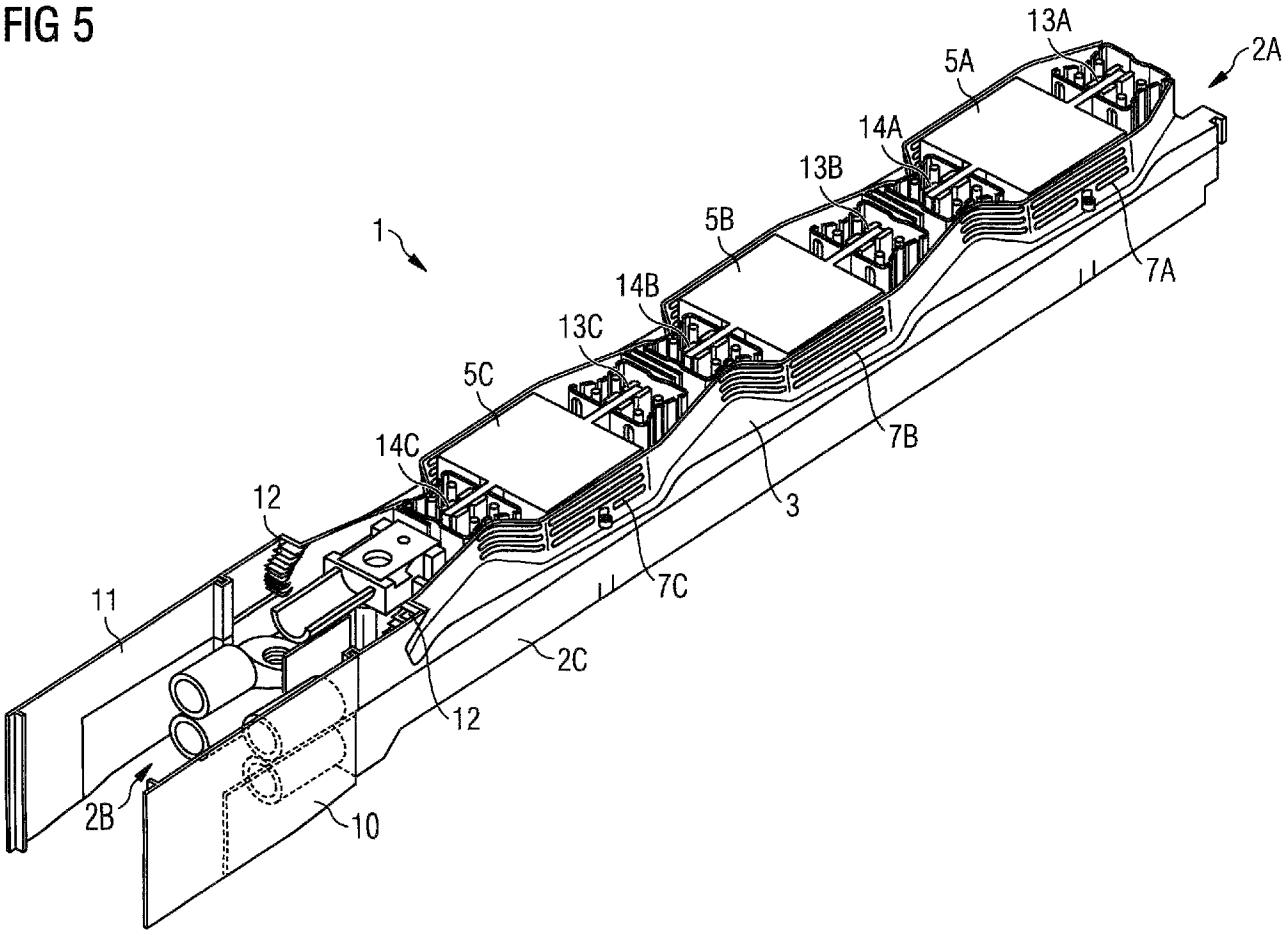
FIG. 5 is a further cross-sectional view of an embodiment of the fuse load-break switch according to the invention, using a section extending in a plane of a heat dissipation duct.

FIG. 2 shows the fuse load-break switch 1 in the open switch position after the switching handle 4 is actuated. The pivoted-out fuse inserts 5A, 5B, 5C for the three current phases L1, L2, L3 can be seen in FIG. 2. The three pivoted-out covers 6A, 6B, 6C for the three current inserts 5A, 5B, 5C can further be seen in FIG. 2. In the embodiment shown in FIG. 2, the switching handle 4 is attached to the central cover 6B for single-pole connection of the current phase. As can be seen from FIG. 2, the pivoted-out fuse inserts 5A, 5B, 5C are easily accessible for an operator and can be replaced without difficulty. The fuse load-break switch 1 shown in FIG. 1, 2, which can be connected in a multi-pole manner, can be mounted transversely on substantially horizontally extending busbars. After being mounted, the various fuse inserts 5A, 5B, 5C provided for the busbars are arranged in a row together within the housing 2 of the mounted fuse load-break switch 1. As can be seen in FIG. 1, 2, a vertically extending heat dissipation duct 3, through which the thermal power losses brought about by the fuse inserts 5A, 5B, 5C escape vertically upwards towards an upper end face 2A of the housing 2, is provided on one or preferably both of the side walls of the housing 2 of the fuse load-break switch 1 mounted on the busbars. In one possible embodiment, two heat dissipation ducts 3-1, 3-2 are provided as tub-shaped depressions on the two side walls of the housing 2 of the fuse load-break switch 1. If in this case a plurality of fuse load-break switches 1 are mounted side by side on the busbars, the tube-shaped depression of the heat dissipation duct 3 forms, together with the tub-shaped depression of the heat dissipation duct 3' of the directly adjacently arranged fuse load-break switch 1', a closed duct through which the thermal power loss can escape upwards. In a preferred embodiment, the housing 2 comprises slits or openings 12 on a lower end face 2B, in such a way that the heat dissipation duct 3 to some extent forms a chimney through which the heated air can escape upwards through discharge openings 36-1, 36-2 on the upper end face 2A, as can be seen in FIG. 5.

As can be seen in FIG. 1, 2, for the different fuse inserts 5A, 5B, 5C the housing 2 laterally comprises respective heat dissipation slits 7A, 7B, 7C, through which heat or thermal energy can escape from the interior of the housing 2 into the heat dissipation duct 3, from where it is transported off upwards through dissipation openings on the end face 2A. In a further possible embodiment, cool air is supplied to the heat dissipation duct 3 via the openings provided on the lower end face 2B, and forcibly entrains the laterally exiting fuse heat upwards. The fuse inserts 5A, 5B, 5C may be low-voltage high-power fuses or UL fuses. In one possible embodiment, the busbars are arranged with a rail spacing of 185 mm. In one possible embodiment, the busbars may have a busbar width of up to 120 mm. The fuse load-break switch 1 can be pulled under load, the manually actuable switching handle 4, as shown in FIG. 2, preferably being pivoted downwards. As a result of this pivot movement, the switching linkage located in the housing 2 is actuated, the fuse inserts 5A, 5B, 5C being pivoted out of a contact of the associated fuse contact pair to disconnect the associated current phase L1, L2, L3. At the same time, the switching linkage opens the cover 6A, 6B, 6C, in such a way that the pivoted-out fuse inserts 5A, 6B, 5C, as shown in FIG. 2, become visible and can be replaced.

When the switching contacts or fuse contacts are switched, switching gases are produced, in particular ionised air, comprising contact material particles, in particular copper particles. During switching, the switching gases may be produced at a high pressure. The switching gases comprising the metal particles contained therein may be electrically conductive. In a preferred embodiment of the fuse load-break switch 1 according to the invention, the resulting switching gases are dissipated in a switching gas dissipation duct 8A, 8B, 8C, as shown in FIG. 1, 2, which is provided laterally on the housing 2 of the fuse load-break switch 1 and separated from the heat dissipation duct 3. In the embodiment shown, each fuse insert or each fuse contact pair is provided with its own switching gas dissipation duct 8A, 8B, 8C for dissipating the switching gases. In the fuse load-break switch 1, there is a clear separation between dissipating the switching gases and dissipating the thermal losses. As a result, reliable switching can be carried out without risk even under extreme ambient conditions. As can be seen in FIGS. 1 and 2, slits or openings 9A, 9B, 9C, which connect the switching gas dissipation duct 8A, 8B, 8C to the interior of the housing 2, are provided in the inner housing 2 of the fuse load-break switch 1 for each switching gas dissipation duct 8A, 8B, 8C. Further, each switching gas dissipation duct 8A, 8B, 8C may comprise outlet ducts or outlet slits, through which the switching gases, produced in the manner of an explosion, exit the interior of the housing 2 into the switching gas dissipation duct 8A, 8B, 8C. In a preferred embodiment, these outlet openings may comprise angled fins, which deflect the gas which is produced in the manner of an explosion, slowing down the released gas. As a result, for example, a distance from earthed components can be reduced. In one possible embodiment, extinguishing plates or the like can be omitted as a result of the outlet ducts for the switching gases.

Figure 3:
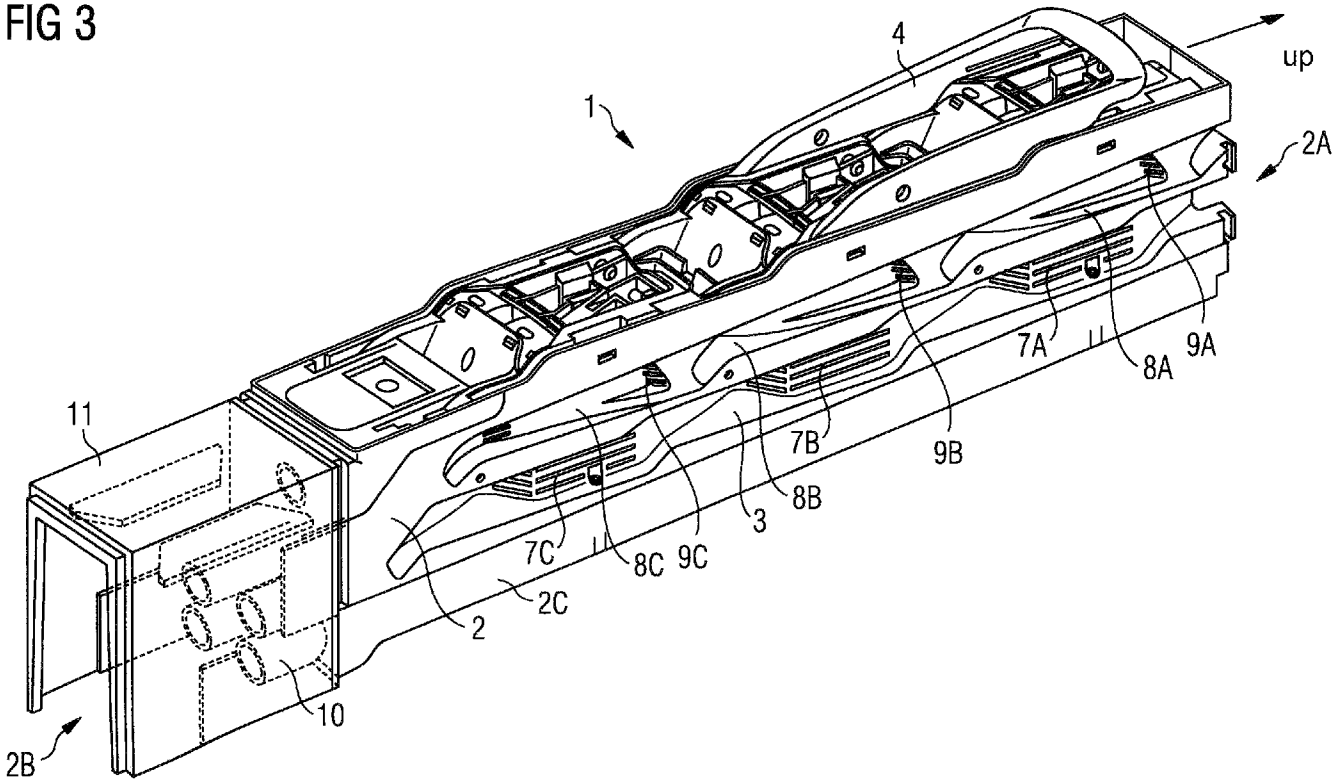
FIG. 3 is a view of an embodiment of the fuse load-break switch according to the invention from diagonally above.

FIG. 3 is a view of a fuse load-break switch 1 from diagonally below. In FIG. 3, the fuse load-break switch 1 is located in the closed position. A heat dissipation duct 3 and switching gas dissipation ducts 8A, 8B, 8C separated therefrom can be seen laterally on the housing 2 in FIG. 3. On the lower end face 2B of the housing 2, there are cable shoes 10 for electrical output lines. The cable shoes 10 are shielded by a sheathing 11.

Figure 4:
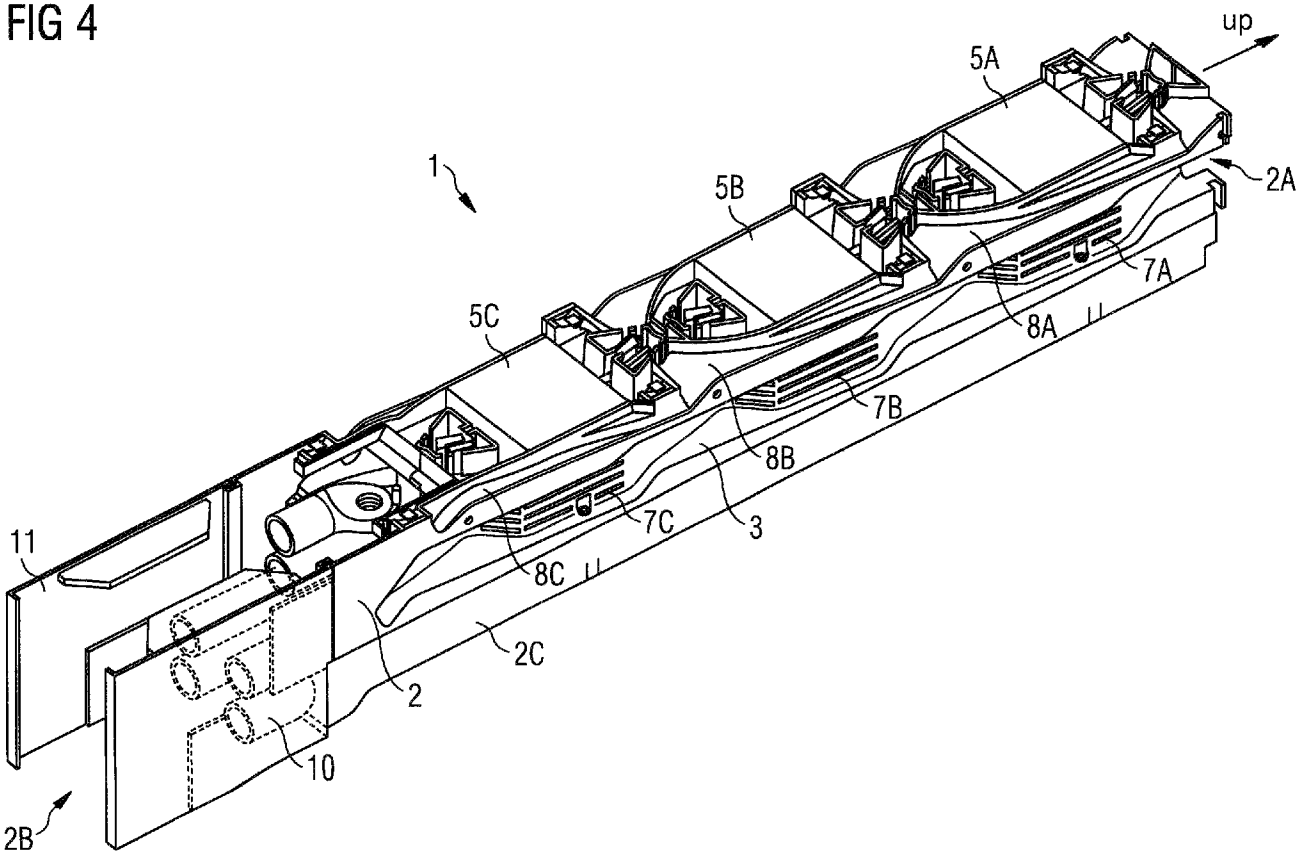
FIG. 4 is a cross-sectional view of an embodiment of the fuse load-break switch according to the invention, using a section extending in a plane of a switching gas dissipation duct.

FIG. 4 is a further view of a fuse load-break switch 1 from diagonally above, an upper part of the housing 2 along with the switching handle 4 being removed, making the fuse inserts located within the housing 2 visible when not pivoted out. The fuse inserts 5A, 5B, 5C for three different current phases L1, L2, L3 can be seen in FIG. 3. The fuse inserts 5A, 5B, 5C are for example low-voltage high-power fuses which are provided for nominal currents of up to 630 amps. For each current phase to be disconnected, a fuse contact pair for receiving a fuse insert or a fuse 5A, 5B, 5C is provided. The heat or thermal energy generated by the fuse inserts 5A, 5B, 5C is released laterally through the slits 7A, 7B, 7C to the heat dissipation duct 3. The fuse inserts 5A, 5B, 5C can be pivoted out by actuated the switching handle 4 to disconnect the respective current phase L1, L2, L3. The switching gases produced during switching are released to the switching gas dissipation ducts 8A, 8B, 8C. As a result of the heat dissipation duct 3, the thermal power losses of the fuse inserts 5A, 5B, 5C are kept low, it being ensured in all cases that the temperature thresholds in accordance with the standard are not exceeded.

FIG. 5 is a further view of an embodiment of the fuse load-break switch 1 according to the invention, a further part, specifically the upper switch part, having been removed by comparison with FIG. 4. The head dissipation duct 3 comprising the heat dissipation slits 7A, 7B, 7C provided laterally on the fuse inserts 5A, 5B, 5C can be seen in FIG. 5. The heat dissipation slits 7A, 7B, 7C are located in the direct vicinity of the fuse inserts 5A, 5B, 5C and enclose them so as to dissipate as much thermal energy as possible into the heat dissipation duct 3. In FIG. 5, slits 12, via which cooling air can flow into the associated heat dissipation duct 3, are provided on the lower end face 2B of the housing 2, producing a chimney effect. The fuse insert 5A, 5B, 5C preferably comprises two associated switch contact blades 13, 14, as shown in FIG. 5. Each fuse insert 5A, 5B, 5C comprises an upper switch contact blade 13A, 13B, 13C and a lower switch contact blade 14A, 14B, 14C. When unpivoted, the switch contact blades 13A, 13B, 13C, 14A, 14B, 14C are inserted into an associated fuse contact. For each fuse insert 5A, 5B, 5C, a fuse contact pair 27A, 28A, 27B, 28B, 27C, 28C comprising two fuse contacts is provided, the two fuse contacts being in contact with the switch contact blades 13A, 13B, 13C, 14A, 14B, 14C when the fuse load-break switch 1 is in the closed switch position.

Figure 6:
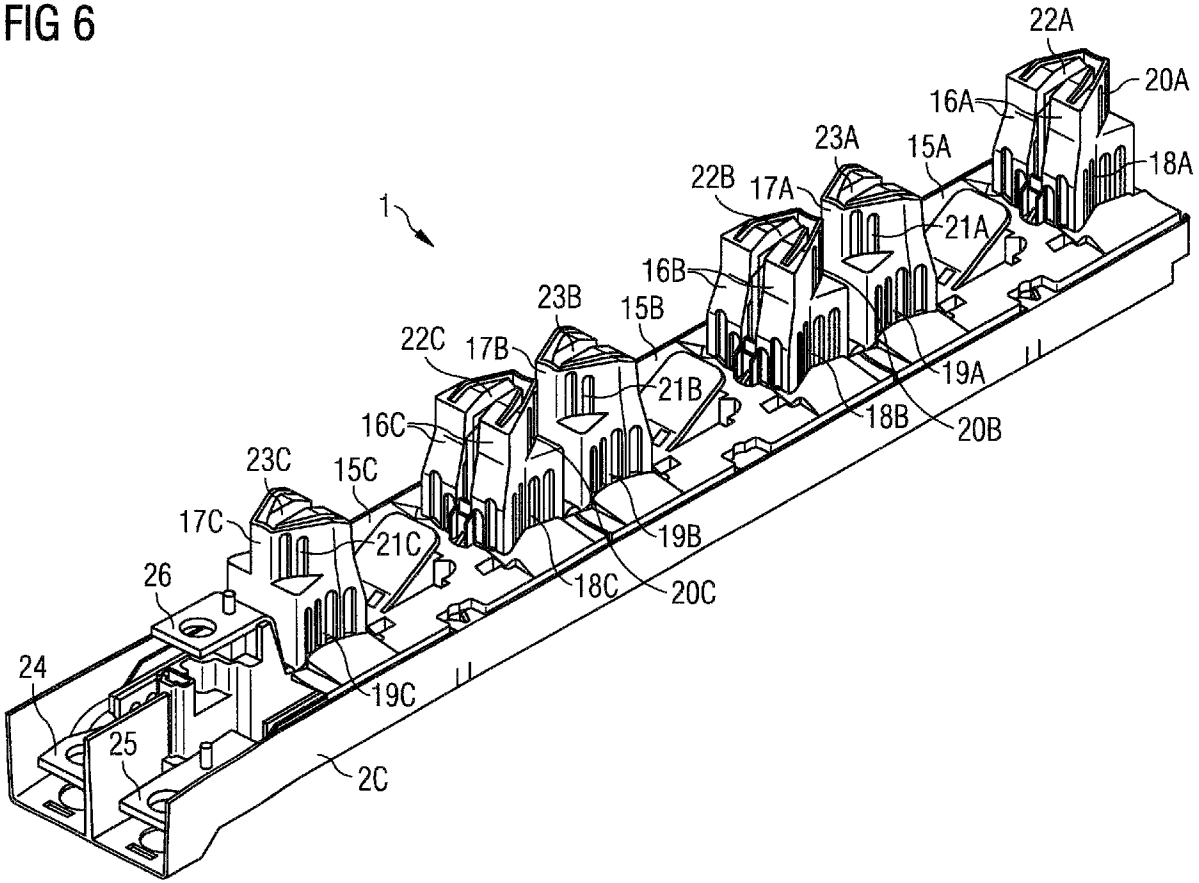
FIG. 6 is a further view of an embodiment of the fuse load-break switch according to the invention, with the upper part removed to show the shock protection caps contained in the fuse load-break switch.
Figure 11A:
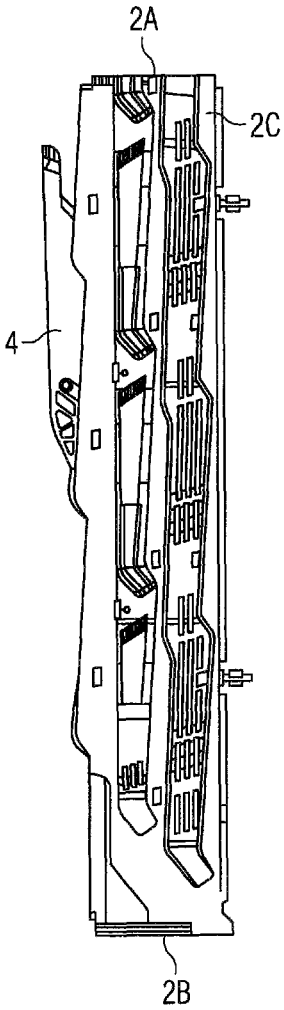
FIG. 11*a*, 11*b*, 11*c* are views illustrating different mounting options for the fuse load-break switch according to the invention.
Figure 11B:
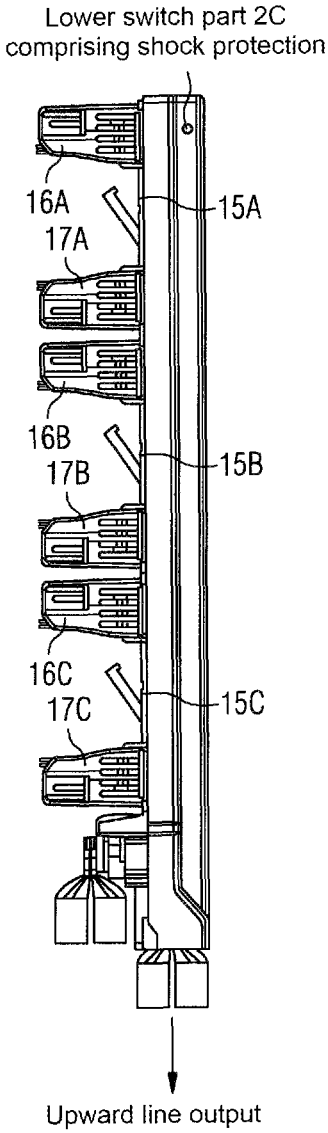
Figure 11C:
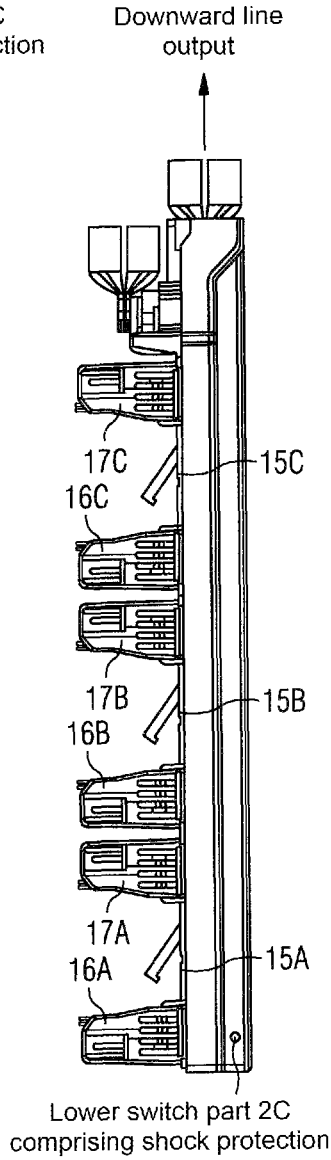

FIG. 6 is a further view of an embodiment of the fuse load-break switch 1 according to the invention, the fuse inserts 5A, 5B, 5C having been removed. Each fuse contact pair of a fuse insert 5A, 5B, 5C has two fuse contacts, which are covered by a symmetrical shock protection cap 15A, 15B, 15C. Each shock protection cap 15A, 15B, 15C has two cap heads 16A, 17A, 16B, 17B, 16C, 17C. The shock protection caps 15A, 15B, 15C do not need to be removed from the lower switch part. The entire lower switch part is rotated when the connection direction needs to be changed. The upper switch part is placed on the lower switch part again unchanged, and locked in such a way that the direction of operation is maintained, as shown in FIG. 11*a*, 11*b*, 11*c*. The cap heads 16A, 16B, 16, 17A, 17B, 17C on the shock protection caps 15A, 15B, 15C have heat outlet openings 18A, 18B, 18C and 19A, 19B, 19C as well as switching gas outlet openings 20A, 20B, 20C, 21A, 21B, 21C, as shown in FIG. 6. The upper cap heads 16A, 16B, 16C and lower cap heads 17A, 17B, 17C each have slits for enclosing the fuse contacts, into which the switch contact blades 13A, 13B, 13C, 14A, 14B, 14C shown in FIG. 5 can be introduced. The contact slits 22A, 22B, 22C in the upper cap head 16A, 16B, 16C and the contact slits 23A, 23B, 23C in the lower cap heads 17A, 17B, 17C can be seen in FIG. 6. The switching gases produced during switching are dissipated through the switching gas outlet slits 20A, 20B, 20C into the switching gas dissipation ducts 8A, 8B, 8C. The heated air released through the head dissipation slits 18A, 18B, 18C, 19, 19B, 19C reaches the two laterally provided heat dissipation ducts 3. Three contact tabs 24, 25, 26 for three separate current phases L1, L2, L3 can be seen in FIG. 6. The arrangement of the contact tabs 24, 25, 26 makes it possible to rotate the fuse load-break switch 1 according to the invention. As can be seen in FIG. 6, the contact tab 26 for example can be provided either for the current phase L1 or for the current phase L3 depending on the positioning of the fuse load-break switch 1.

Figure 7:
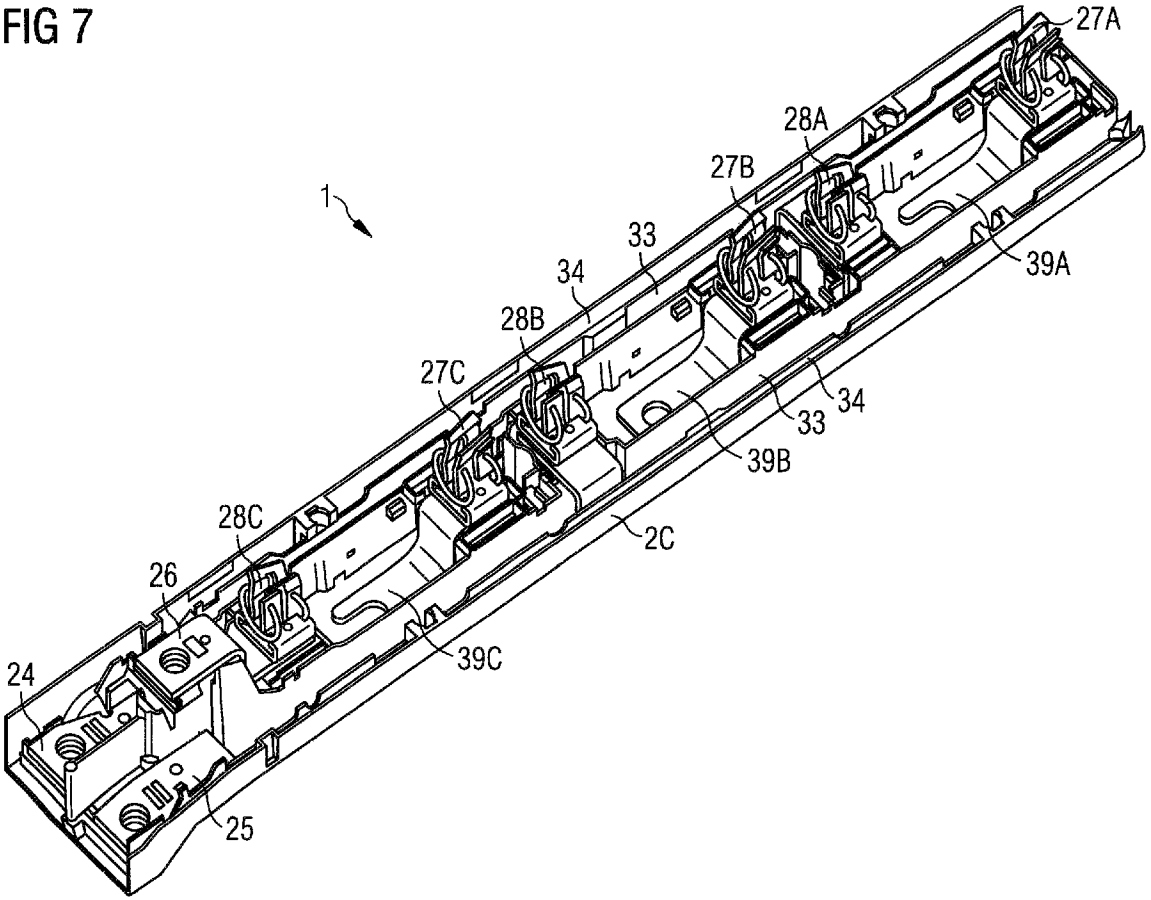
FIG. 7 is a view of an embodiment of the fuse load-break switch according to the invention after the shock protection caps have been removed.
Figure 8:
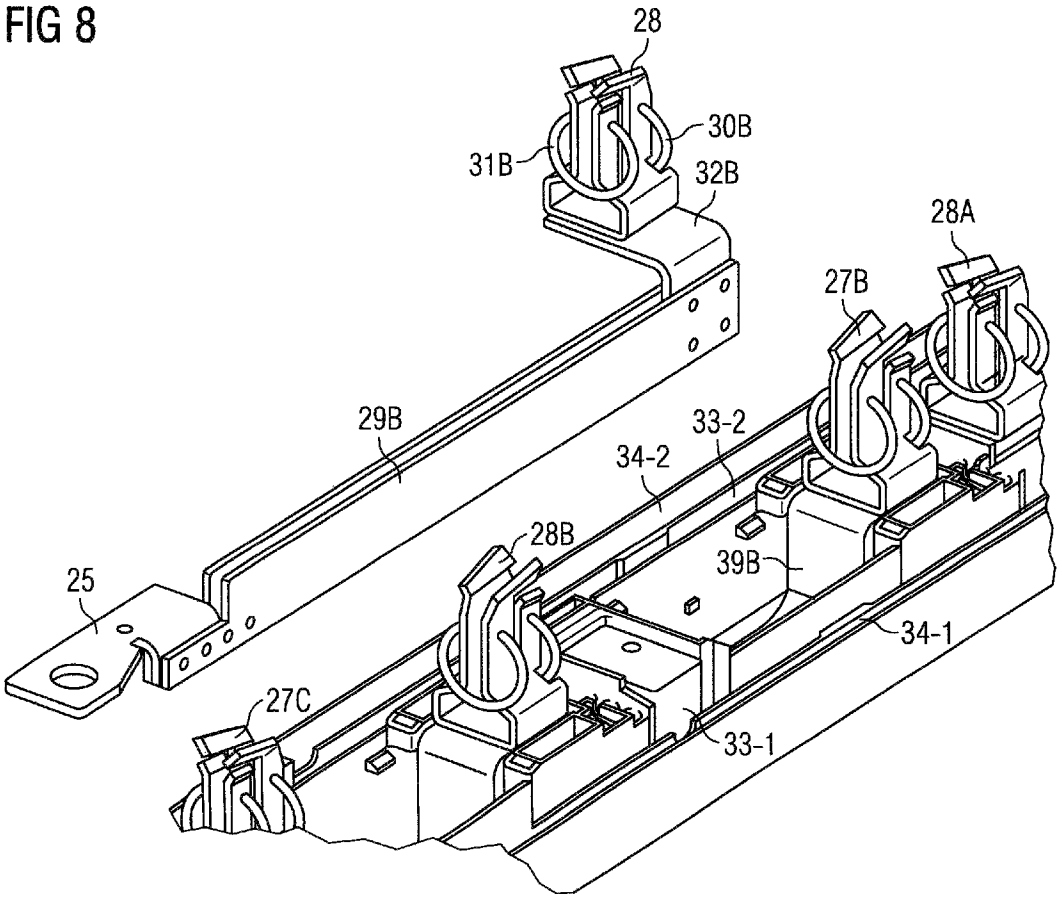
FIG. 8 is a view of an embodiment of the fuse load-break switch according to the invention to illustrate the output rails contained within the fuse load-break switch.

FIG. 7 is a further view of a possible embodiment of the fuse load-break switch 1 according to the invention, showing the lower switch part. Contact pairs 27A, 28A, 27B, 28B, 27C, 28C for inserting the fuse inserts 5A, 5B, 5C can be seen in FIG. 7. A fuse contact of the fuse contact pair 27A, 28A, 27B, 28, 27C, 28C is connected to a connecting bracket or a contact tab 24, 25, 26 via a fuse contact bracket and an output rail. This is illustrated in FIG. 8. The two fuse contacts 27B, 28B, which are provided for the middle fuse insert 5B for the current phase L2, can be seen in FIG. 8. The fuse contact 27B, which is positioned above when the fuse load-break switch 1 is mounted, contacts an associated busbar via an access rail 39B when mounted. The upper fuse contact 27B forms an access contact for the fuse contact pair 27B, 28B of the second current phase L2. An output contact 28B is positioned opposite the access contact 27B and is connected to a connection bracket or to the tab 25 provided for the current phase L2 via an output rail 29B. The output rail 29B can, as shown in FIG. 8, be connected to the connection bracket 25 by way of two parallel planar output rail parts. In this embodiment, the output rail 29B is in the form of two parallel rails. The connection bracket 25 is fixed between the two output rail parts. The embodiment shown in FIG. 8 has the advantage that one rivet or additional element is sufficient for mounting by clinching or by stamping and bending. Dividing the output rail 29B into two output rail parts makes simple surface-finishing of the connection bracket or connection tab possible. The two output rail parts themselves are not surface-finished. As can further be seen in FIG. 8, the fuse contacts, such as the output contact 28B shown in FIG. 8, may have contact springs 30B, 31B. The fuse contact bracket 32B shown in FIG. 8 is fixed between the two output rail parts of the output rail 29B at a first end of the two parallel output rail parts of the output rail 29B. The connection bracket 25 is located at a second end of the two parallel output rail parts and is likewise fixed between the two output rail parts in a simple manner.

As is shown in FIG. 8, the two parallel output rail parts of the output rail 29B can be inserted into an inner guide duct 33-1 extending parallel to the two side walls of the housing 2 within the housing 2 of the fuse load-break switch. As can also be seen in FIG. 8, at least one further parallel outer guide duct 34-1, 34-2 in each case for receiving electrical lines is located between the two side walls of the housing 2 and the two inner guide ducts 33-1, 33-2. The two inner guide ducts 33-1, 33-2 and the two outer guide ducts 34-1, 34-2 within the housing 2 extended substantially vertically when the fuse load-break switch 1 is mounted, in such a way that the thermal power losses of the output rails 29A, 29B, 29C and the electric lines are dissipated upwards through openings on the upper end face 2A of the housing 2 to the outside.

Figure 9:
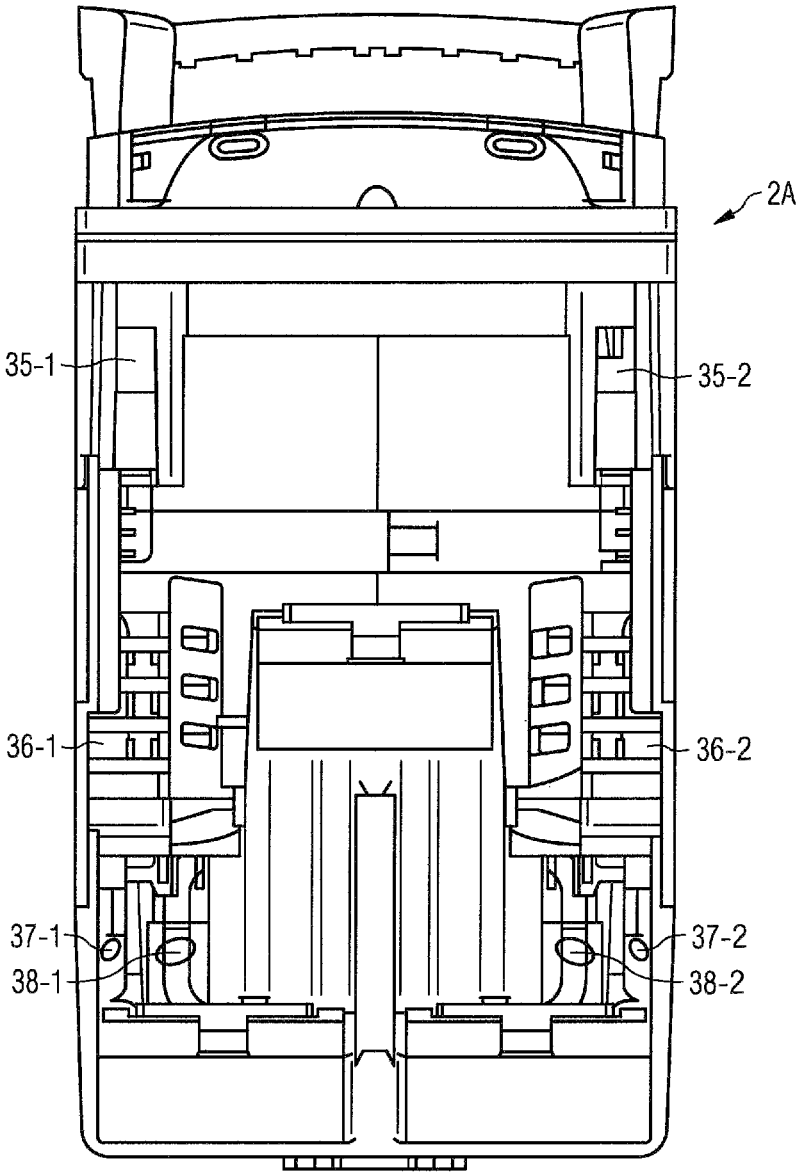
FIG. 9 is a view of an upper end face of an embodiment of the fuse load-break switch according to the invention.

FIG. 9 is a view towards the upper end face 2A of the housing 2 of the fuse load-break switch 1. Protective gas outlet openings 35-1, 35-2 and outlet openings 36-1, 36-2 for releasing the heated air which escapes from the two heat dissipation ducts 3-1, 3-2 can be seen in FIG. 9. Openings 37-1, 37-2 for the two outer guide ducts 34-1, 34-2 and openings 38-1, 38-2 for the two inner guide ducts 33-1, 33-2 can further be seen.

Figure 10:
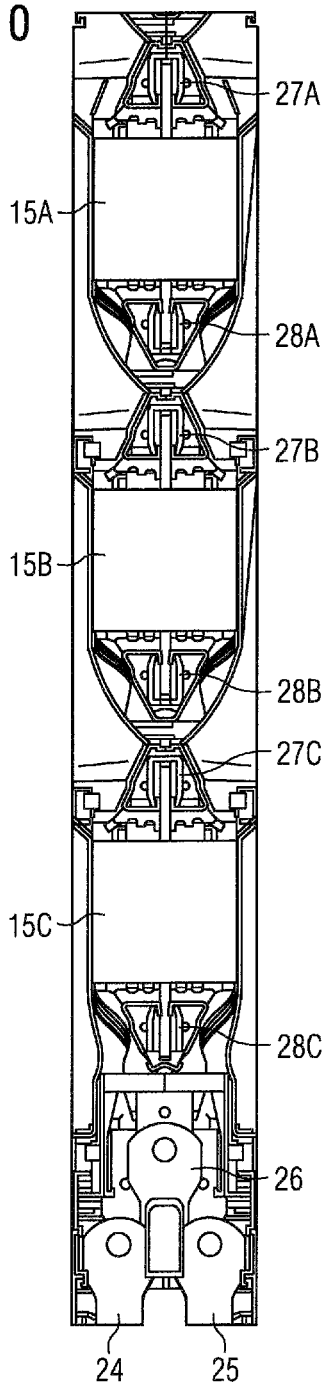
FIG. 10 is a view of an embodiment of the fuse load-break switch according to the invention as shown in FIG. 4.

FIG. 10 is a view from above of an embodiment of the fuse load-break switch 1 according to the invention, the upper part of the housing 2 having been removed, as shown in FIG. 5, and the inserted fuse inserts 5A, 5B, 5C being visible. In one possible embodiment, the output rail 29B shown in FIG. 8 and the two further output rails 29A, 29C may be formed in one piece. In a preferred embodiment, the output rails 29A, 29B, 29C consist of output rail parts, arranged parallel. The arrangement of the parallel output rail parts increases the heat dissipation because of the larger surface area, a reduction in cross-section also being achieved so as to save copper material.

As a result of the symmetrical shock protection cap 15 shown in FIG. 6, the thermal losses of the fuse inters 5A, 5B, 5C in a lower region are dissipated laterally through the shock protection cap 15A, 15B, 15C into the heat dissipation duct 3. Therefore, even in a composite arrangement where for example a plurality of fuse load-break switches 1 are mounted above one another on busbars, the thermal losses can flow upwards unimpeded and does not additionally detract from the fuse inserts positioned above.

Just like the thermal losses, the switching gases are passed into a duct, which is positioned above and sealed off below, and dissipated upwards. The shock protection caps 15A, 15B, 15C comprise switching gas outlet openings 20A, 20B, 20C, 21A, 21B, 21C specially provided for this purpose, which are in an upper region of the shock protection caps 15A, 15B, 15C. In one possible embodiment of the fuse load-break switch 1 according to the invention, it can be locked in the open and/or in the closed position. The possibility of locking in the open position ensures that that it cannot accidentally be switched back on, for example during maintenance. In one possible embodiment, the fuse inserts 5A, 5B are in the form of melting fuses, and bring about a relatively high power loss of for example more than 60 watts, resulting in more than 180 watts of thermal power loss in total. The heat dissipation duct 3 is preferably sized in such a way that it reliably transports off a high thermal power loss of this type without exceeding the temperature threshold of the applicable standard.

The invention claimed is:

1. A fuse load-break switch for mounting to a busbar, the fuse load-break switch configured for receiving low-voltage high-power fuses for disconnecting different current phases, the fuse load-break switch comprising:

a housing including laterally disposed side walls, each side wall having at least one tub-shaped depression extending along an exterior surface of the side wall; and a fuse contact pair provided within the housing, the fuse contact pair adapted for receiving a fuse for each current phase to be disconnected, wherein the depressions in the side walls are configured to form together with depressions in the side walls of another fuse load-break switch directly adjacently arranged alongside at least one closed heat dissipation duct and at least one closed switching gas dissipation duct, and wherein a thermal power loss brought about by the fuses is dissipated into the at least one heat dissipation duct provided laterally on the housing of the fuse load-break switch.

2. The fuse load-break switch according to claim 1, wherein switching gases are dissipated into the at least one switching gas dissipation duct provided laterally on the housing of the fuse load-break switch and separated from the at least one heat dissipation duct.

3. The fuse load-break switch according to claim 1, wherein each fuse contact pair comprises two fuse contacts, each fuse contact covered by a symmetrical shock protection cap comprising two cap heads.

4. The fuse load-break switch according to claim 3, wherein the cap heads have heat outlet openings and switching gas openings separated from the heat outlet openings.

5. The fuse load-break switch according to claim 1, wherein the housing is mounted transversely on substantially horizontally extending busbars for receiving a plurality of fuses provided for the different busbars arranged in a row together within the housing of the mounted fuse load-break switch.

6. The fuse load-break switch according to claim 5, wherein a heat dissipation duct through which the thermal power loss brought about by the fuses escapes is provided on both of the side walls of the housing of the fuse load-break switch mounted on the busbars.

7. The fuse load-break switch according to claim 5, wherein a switching gas dissipation duct for dissipating a switching gas produced during switching is provided on both side walls of the housing of the fuse load-break switch mounted on the busbars.

8. The fuse load-break switch according to claim 1, a fuse contact bracket, a connecting bracket, and an output rail including two parallel output rail parts, wherein a fuse contact of the fuse contact pair is connected to the connecting bracket via the fuse contact bracket and the output rail parts of the output rail.

9. The fuse load-break switch according to claim 8, wherein the fuse contact bracket is fixed between the two parallel output rail parts of the output rail at a first end of the two parallel output rail parts.

10. The fuse load-break switch according to claim 8, wherein the connecting bracket is fixed between the two parallel output rail parts of the output rail at a second end of the two parallel output rail parts.

11. The fuse load-break switch according to claim 1, wherein the parallel output rail parts of the output rail are each inserted into an inner guide duct extending parallel to the side walls of the housing within the housing of the fuse load-break switch.

12. The fuse load-break switch according to claim 11, wherein at least a further parallel outer guide duct for receiving electrical lines is provided between the side walls of the housing and the inner guide duct.

13. The fuse load-break switch according to claim 12, wherein the guide ducts extend within the housing of the fuse load-break switch mounted on the busbars, the thermal losses of the output rails or the electrical lines being dissipated upwards through openings of the housing to the outside of the housing.

14. The fuse load-break switch according to claim 1, wherein to disconnect a current phase the corresponding fuse can be pivoted out of the associated fuse contact pair.

15. The fuse load-break switch according to claim 1, further comprising a movable push rod disposed in the housing and adapted for pivoting the fuses out of the fuse contact pairs associated with the current phases, and a manually actuable switching handle attached to the push rod, wherein a plurality of current phases can be disconnected simultaneously using the manually actuable switching handle.

16. A current distribution arrangement comprising a plurality of substantially horizontally extending busbars for different current phases of a multi-phase power supply system, and at least one fuse load-break switch configured for receiving low-voltage high-power fuses for disconnecting different current phases and being mounted on the busbars, the fuse load-break switch comprising a housing including laterally disposed side walls, each side wall having at least one tub-shaped depression extending along an exterior surface of the side wall, and a fuse contact pair provided within the housing, the fuse contact pair adapted for receiving a fuse for each current phase to be disconnected, wherein the depressions in the side walls are configured to form together with depressions in the side walls of another fuse load-break switch directly adjacently arranged alongside at least one closed heat dissipation duct and at least one closed switching gas dissipation duct, and wherein a thermal power loss brought about by the fuses is dissipated into the at least one heat dissipation duct provided laterally on the housing of the fuse load-break switch.

17. The current distribution arrangement according to claim 16, wherein the current distribution arrangement is configured for a nominal current of more than 600 amps.

18. The current distribution arrangement according to claim 16, wherein the busbars are arranged with a rail spacing of 185 mm and each have a busbar width of up to 120 mm.

19. The current distribution arrangement according to claim 16, wherein the fuses are low-voltage high-power fuses or UL fuses.

20. The current distribution arrangement according to claim 16, wherein the fuse load-break switch can be connected in a single-pole or multi-pole manner.

21. A fuse load-break switch for low-voltage high-power fuses, the fuse load-break switch comprising a fuse contact pair for receiving a fuse being provided within a housing of the fuse load-break switch for each current phase to be disconnected, wherein a thermal power loss brought about by the fuses is dissipated into at least one heat dissipation duct provided laterally on the housing of the fuse load-break switch, and wherein a fuse contact of the fuse contact pair is connected to an associated connecting bracket via a fuse contact bracket and two parallel planar output rail parts of an output rail.

22. A fuse load-break switch for low-voltage high-power fuses, the fuse load-break switch comprising a fuse contact pair for receiving a fuse being provided within a housing of the fuse load-break switch for each current phase to be disconnected, the fuse contact pair comprising two fuse contacts, each fuse contact covered by a symmetrical shock protection cap comprising two cap heads, each cap head having heat outlet openings and switching gas openings separated from the heat outlet openings, wherein a thermal power loss brought about by the fuses is dissipated into at least one heat dissipation duct provided laterally on the housing of the fuse load-break switch.

* * * * *